US006546613B2

(12) United States Patent
Donovan

(10) Patent No.: US 6,546,613 B2
(45) Date of Patent: Apr. 15, 2003

(54) ANVIL DESIGN FOR RIVET SETTING MACHINE

(75) Inventor: Steven P. Donovan, Roscoe, IL (US)

(73) Assignee: Textron Inc., Providence, RI (US)

( * ) Notice: Subject to any disclaimer, the term of this patent is extended or adjusted under 35 U.S.C. 154(b) by 0 days.

(21) Appl. No.: 09/942,209

(22) Filed: Aug. 29, 2001

(65) Prior Publication Data

US 2003/0046804 A1 Mar. 13, 2003

(51) Int. Cl.[7] ..... B21D 39/00; B23P 11/00

(52) U.S. Cl. ..... 29/524.1; 29/243.53; 29/243.54; 29/525.06; 72/414; 72/466.5

(58) Field of Search ..... 29/243.53, 243.54, 29/524.1, 525.06; 72/412, 414, 466.5

(56) References Cited

U.S. PATENT DOCUMENTS 2,465,534 A * 3/1949 Havener ..... 29/464
4,757,609 A * 7/1988 Sawdon ..... 29/798
5,174,018 A * 12/1992 Muller ..... 29/798
5,177,861 A * 1/1993 Sawdon ..... 29/798
5,361,473 A * 11/1994 Landes ..... 29/243.53
5,752,305 A * 5/1998 Cotterill et al. ..... 29/432.2
6,233,802 B1 * 5/2001 Fulbright ..... 29/243.519
6,263,560 B1 * 7/2001 Edwards ..... 29/798
6,338,601 B1 * 1/2002 Mauer et al. ..... 411/503
6,405,420 B1 * 6/2002 Donhauser et al. ..... 29/243.2

* cited by examiner

*Primary Examiner*—Gregory Vidovich
*Assistant Examiner*—Essama Omgba
(74) *Attorney, Agent, or Firm*—Trexler, Bushnell, Giangiorgi, Blackstone & Marr, Ltd.

(57) ABSTRACT

The present invention provides a novel anvil for a rivet setting machine configured to drive a rivet into a workpiece within a riveting process. The anvil has a cavity therein configured to accommodate a deformation of the rivet and the workpiece during the riveting process. The cavity is defined by a main portion configured to support the workpiece during the riveting process and a relief portion that is proximate to the main portion. The relief portion is configured to provide an area into which the workpiece and the rivet deform during the riveting process. The relief portion includes at least one relief pocket configured to maintain an area which remains unoccupied by the workpiece and the rivet throughout the entire riveting process. The relief portion does not substantially hinder the workpiece and rivet during the riveting process and allows the workpiece and rivet to freely deform during the riveting process.

24 Claims, 14 Drawing Sheets

ANVIL DESIGN FOR RIVET SETTING MACHINE

BACKGROUND OF THE INVENTION

The present invention generally relates to anvil designs used in association with rivet setting machines, and more specifically relates to an anvil design which provides that less force is needed to install a self-piercing rivet.

Self-piercing rivets are used in a variety of applications in order to attach a component to a workpiece or two workpieces together. When a self-piercing rivet is installed to join two workpieces together, the rivet pierces a first workpiece and an anvil deforms the rivet and accommodates deformation of a second workpiece so that while the rivet head is spread to hold the workpieces together in clamped engagement, the rivet does not pierce the second workpiece and, in effect, becomes encapsulated. As a result, the two workpieces become secured together.

This process is generally performed using a rivet setting machine 20, like the one illustrated in FIGS. 1 and 2. The rivet setting machine 20 is typically hydraulically powered and has a generally C-shaped frame 22. One end of the C-shaped frame 22 has a carrier head 24 which holds the rivets 26 therein prior to their being attached to the workpieces 28, 30. Above the carrier head 24 is a driver 32 which drives the rivets 26 from the carrier head 24 into the workpieces 28, 30 along an axis 34. At the opposite end of the C-shaped frame 22, an anvil 136 is attached thereto in alignment with the carrier head. 24. The anvil 136 is used to support the workpieces 28, 30 during the riveting process and has a cavity (not shown in FIGS. 1 or 2, but see FIGS. 3 and 4) therein which allows for the accommodation of the deformation of the rivet 26 and the workpieces 28, 30 during the riveting process.

The cavity 138 in the anvil 136 illustrated in FIGS. 3–9 is representative of the configuration of a cavity that has typically been provided in anvils used in such rivet setting machines 20 for the accommodation of the deformation of the rivets 26 and the workpieces 28, 30 during a riveting process. As best illustrated in FIG. 3, the anvil 136 generally has a first portion 140 and a second portion 142. The second portion 142 is dimensioned to fit within the C-shaped frame 22 of the rivet setting machine 20 while the first portion 140 is dimensioned to rest on top of the C-shaped frame 22. At an end 144 of the first portion 140 opposite where the first portion 140 and the second portion 142 of the anvil 136 are joined together, the cavity 138 is formed therein. The end 144 of the first portion 140 also supports the workpieces 28, 30 during the riveting process.

At the end 144 of the first portion 140, the cavity 138 has a diameter that is smaller than a diameter of the first portion 140 of the anvil 136. The cavity 138 typically defines a side wall 146 that extends from the end 144 of the first portion 140 into the first portion 140 toward the second portion 142. The side wall 146 initially extends from the end 144 toward the second portion 142 at a straight, inward angle such that the diameter of the cavity 138 proximate to the end 142 is larger than the diameter of the cavity 138 proximate to the second portion 142. The side wall 146 then extends further into the first portion 140 toward the second portion 142 at an arc, such that the arced portion 148 of the side wall 146 more dramatically extends toward a center 152 of the first portion 140 than does the straight, angled portion 150 of the side wall 146.

The cavity 138 further defines a main portion 154. The main portion 154 extends from the end of the arced portion 148 of the side wall 146 toward the center 152 of the first portion 140. The main portion 154 extends from the end of the arced portion 148 toward the center 152 at a straight angle toward the end 144 of the anvil 136. Thus, the arced portion 148 of the side wall 146 is the furthest portion of the cavity 138 from the end 144 of the anvil 136.

Disadvantages have arisen with such an anvil design, which will be discussed in regard to the riveting process with such an anvil 136 being used, as illustrated in FIGS. 5–9. As illustrated in FIG. 5, the end 144 of the anvil 136 supports the workpieces 28, 30 and the rivet 26 is forced into contact with the workpiece 28 by the rivet setting machine 20, such that it begins to pierce through the workpiece 28. As the rivet 26 continues to pierce through the workpiece 28, as illustrated in FIGS. 6 and 7, the workpiece 30 deforms into the cavity 138 of the anvil 136 such that the main portion 154 of the cavity 138 supports the workpiece 30.

As illustrated in FIGS. 8 and 9, the continued forcing of the rivet 26 into the workpieces 28, 30, which is necessary for the attachment of the rivet 26 to the workpieces 28, 30, causes the workpiece 30 and the rivet 26 to deform in accordance with the configuration of the cavity 138 such that the rivet 26 is forced toward the arced portion 148 of the cavity 138, thus forcing the deformation of the workpiece 30 to abut against the main portion 154, the arced portion 148 and the side wall 146.

This forcing of the deforming of the workpiece 30 into the main portion 154, the arced portion 148 and the side wall 146 has many disadvantages. One such disadvantage is that during the riveting process, the stress is elevated as there is no place for the material of the workpiece 30 to flow to during the latter stages of the riveting process. The prior art anvil configuration also causes an extreme amount of wear and tear on the anvil 136 because of the material of the workpiece 30 being forced against the main portion 154, the arced portion 148 and the side wall 146. The prior art anvil configuration further does not allow for a wide variance in the range of material thickness of the workpieces 28, 30 that can be handled, such that it can not be ensured that the riveting process will be completed when a variety of thicknesses of workpieces are used, as a thicker workpiece may not be able to be fully deformed within the cavity 138.

Such disadvantages with the prior art anvil configuration have necessitated the need for an improved anvil configuration which overcomes these disadvantages.

OBJECTS AND SUMMARY OF THE INVENTION

A general object of an embodiment of the invention is to provide an anvil configuration for a rivet setting machine that provides a cavity with a relief pocket such that material from a workpiece can flow without encountering resistance from the sidewalls of the anvil during a riveting process.

Another object of an embodiment of the invention is to provide an anvil configuration for a rivet setting machine that allows for the reduction in power or load required for the riveting process.

Yet another object of an embodiment of the invention is to provide an anvil configuration for a rivet setting machine that allows for the downsizing of the C-frame of the rivet setting machine.

Another object of an embodiment of the invention is to provide an anvil configuration for a rivet setting machine that allows for the rivet setting machine to be a pneumatic unit as opposed to a hydraulic unit.

Still another object of an embodiment of the invention is to provide an anvil configuration that reduces the wear on the anvil during the riveting process.

Yet another object of an embodiment of the invention is to provide an anvil configuration that allows the rivet setting machine to handle a wider variance in the range of material thickness of the workpieces to be joined together.

Briefly, and in accordance with at least one of the foregoing objects, an embodiment of the present invention provides an anvil for a rivet setting machine configured to drive a rivet into a workpiece within a riveting process. The anvil has a cavity therein configured to accommodate a deformation of the rivet and the workpiece during the riveting process. The cavity is defined by a main portion configured to support the workpiece during the riveting process and a relief portion that is proximate to the main portion. The relief portion is configured to provide an area into which the workpiece and the rivet deform during the riveting process. The relief portion includes at least one relief pocket configured to maintain an area which remains unoccupied by the workpiece and the rivet throughout the entire riveting process. The relief portion does not substantially hinder the workpiece and rivet during the riveting process and allows the workpiece and rivet to freely deform during the riveting process.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1:
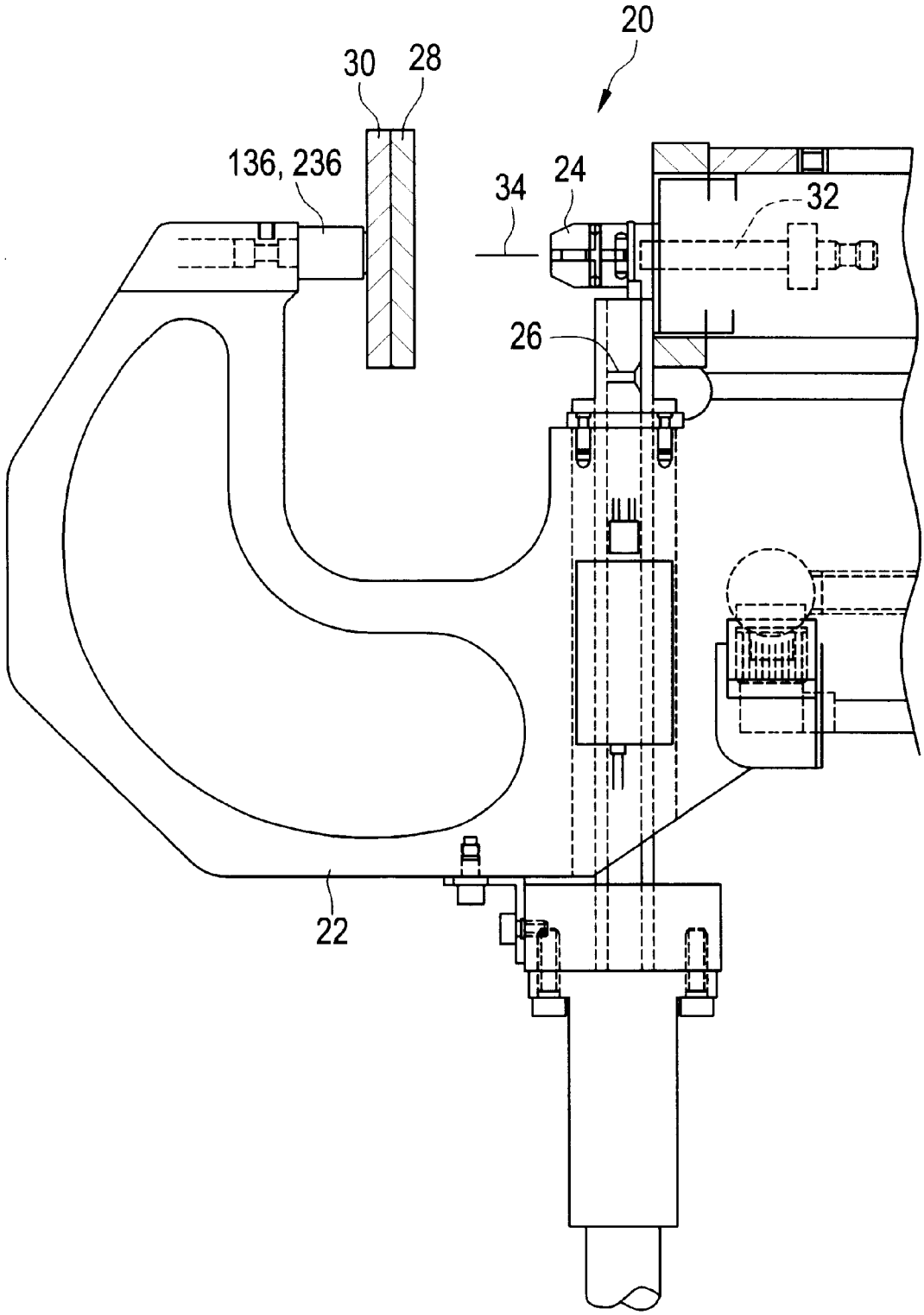
FIG. 1 is a side view of a riveting machine which includes an anvil.
Figure 2:
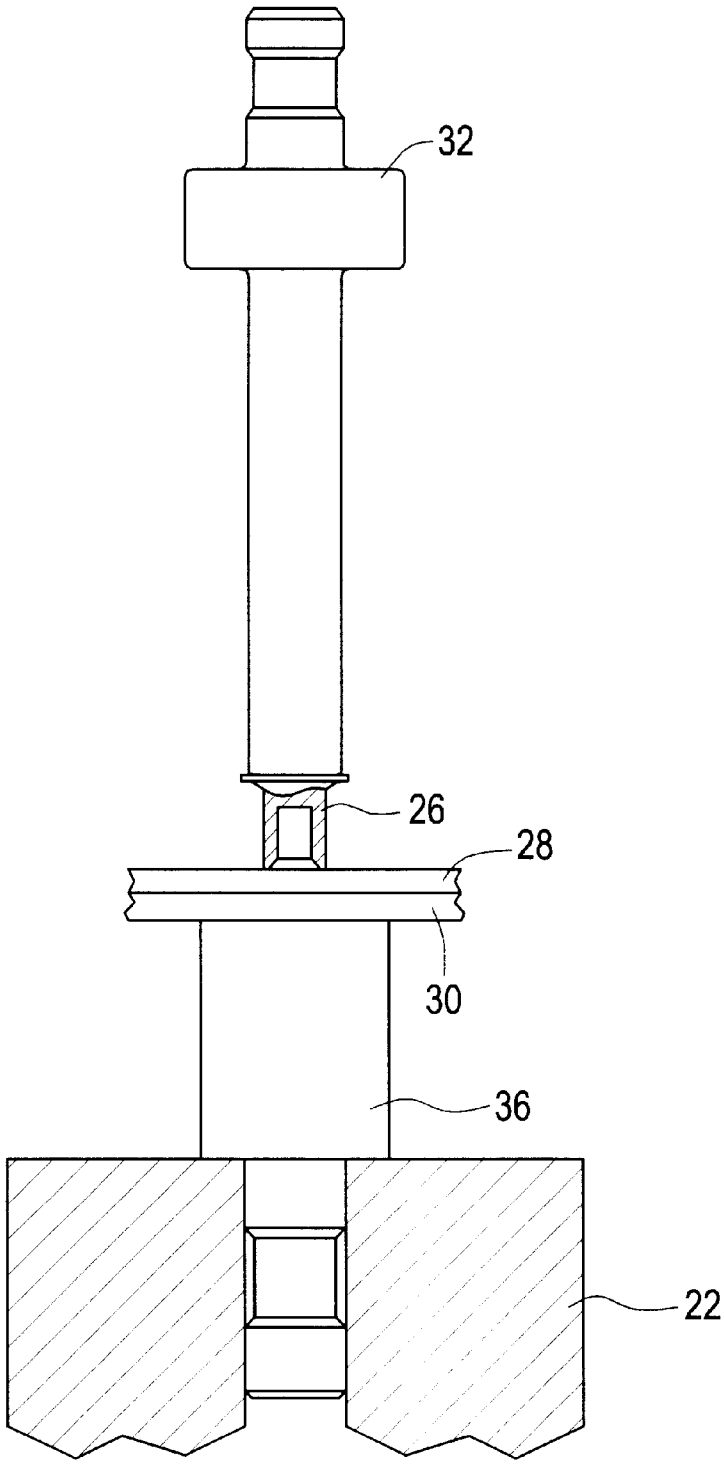
FIG. 2 is front elevational view of a portion of the riveting machine illustrated in FIG. 1, showing the anvil supporting a pair of workpieces and a rivet being prepared to be driven into the workpieces.

While this invention may be susceptible to embodiment in different forms, there is shown in the drawings and will be described herein in detail, a specific embodiment with the understanding that the present disclosure is to be considered an exemplification of the principles of the invention, and is not intended to limit the invention to that as illustrated.

It should also be understood that like reference numerals will denote like elements with the elements of the prior art anvil design being in the one hundreds and the elements of the present novel anvil design being in the two hundreds.

Figure 10:
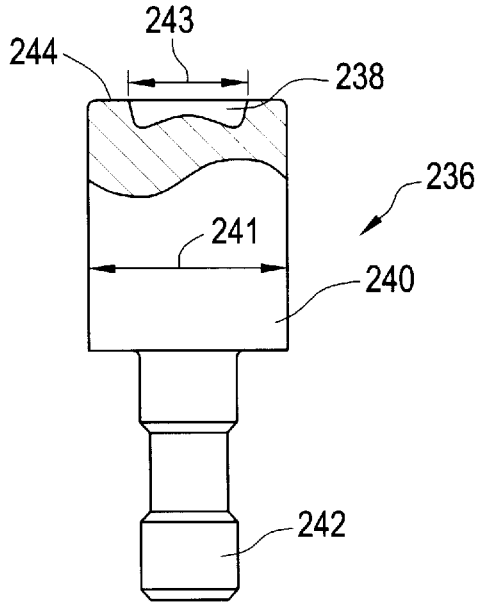
FIG. 10 is a front elevational view of an anvil which is in accordance with an embodiment of the present invention, showing a portion of the anvil in cross-section to illustrate a cavity of the anvil.
Figure 11:
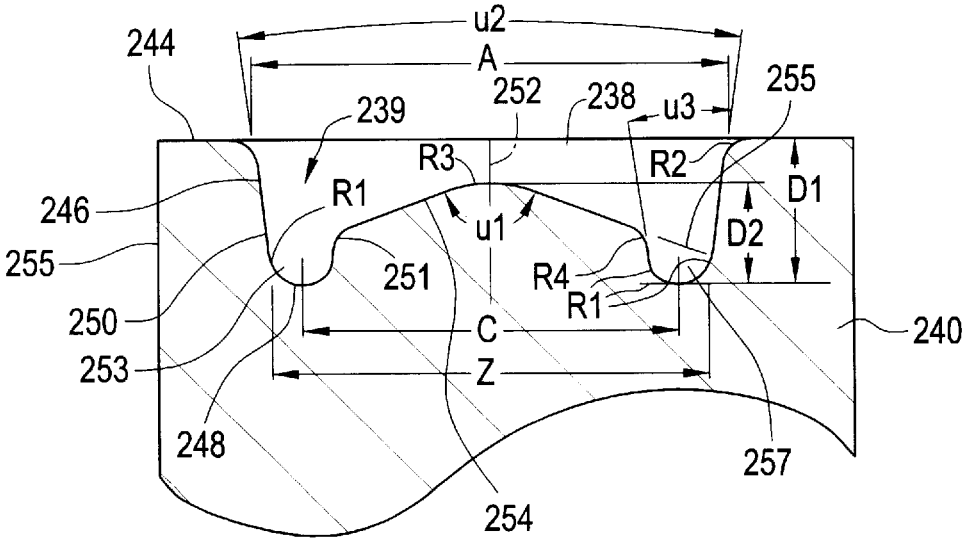
FIG. 11 is an enlarged view of the portion of the anvil in cross-section as illustrated in FIG. 10.

An anvil design which is in accordance with an embodiment of the present invention is illustrated in FIGS. 10 and 11. The anvil design provides a relief pocket 253 in the cavity 238 into which the workpiece 30 deforms while the rivet 26 is being installed. The relief pocket 253 provides that the deforming workpiece 30 does not substantially, if at all, abut against any portion of the side wall 246 of the cavity 238, thus reducing the stress placed on the anvil 236 and the rivet setting machine 20. The reduction of stress placed on the anvil 236 and the rivet setting machine 20 during the riveting process provides many advantages as will be discussed herein.

Figure 3:
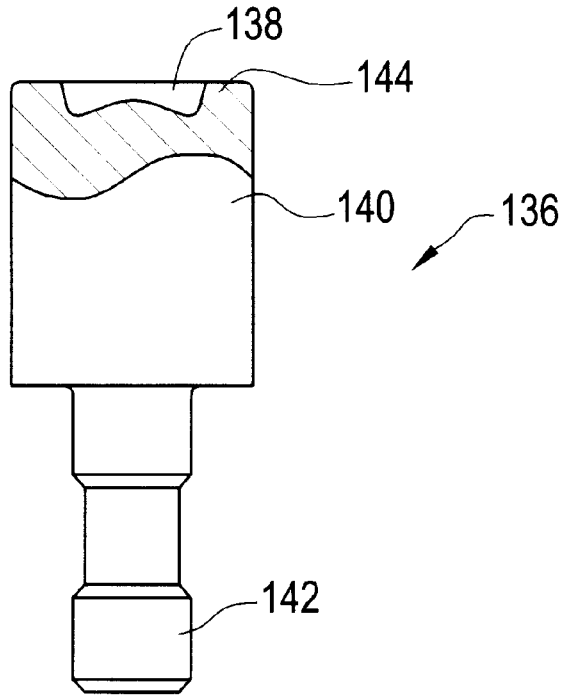
FIG. 3 PRIOR ART
FIG. 3 is front elevational view of a prior art anvil showing a portion of the prior art anvil in cross-section to illustrate a cavity of the prior art anvil.
Figure 4:
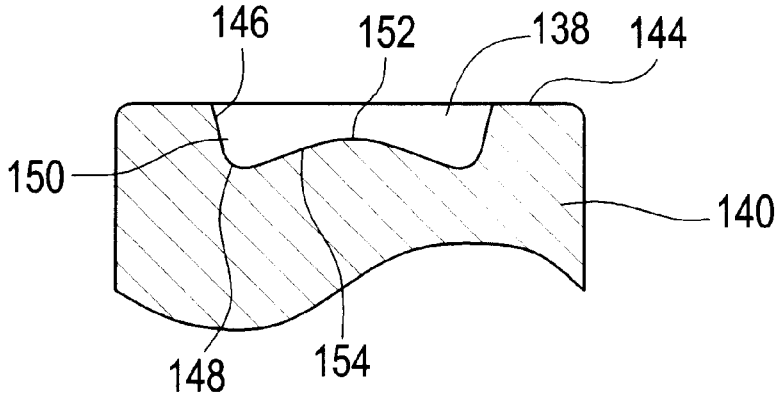
FIG. 4 PRIOR ART
FIG. 4 is an enlarged view of the portion of the prior art anvil in cross-section as illustrated in FIG. 3.
Figure 5:
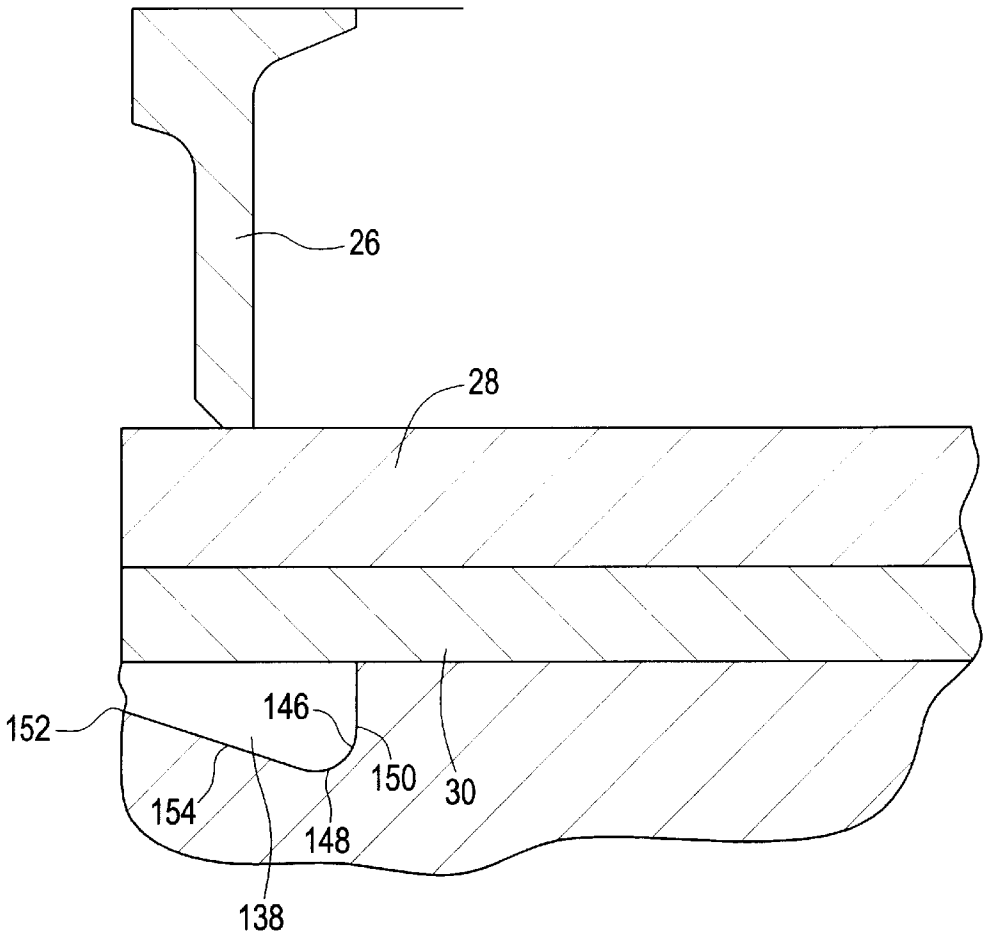
FIG. 5 PRIOR ART
FIGS. 5–9 are cross-sectional views illustrating the installation of a rivet using the anvil. shown in FIGS. 3 and 4.
Figure 6:
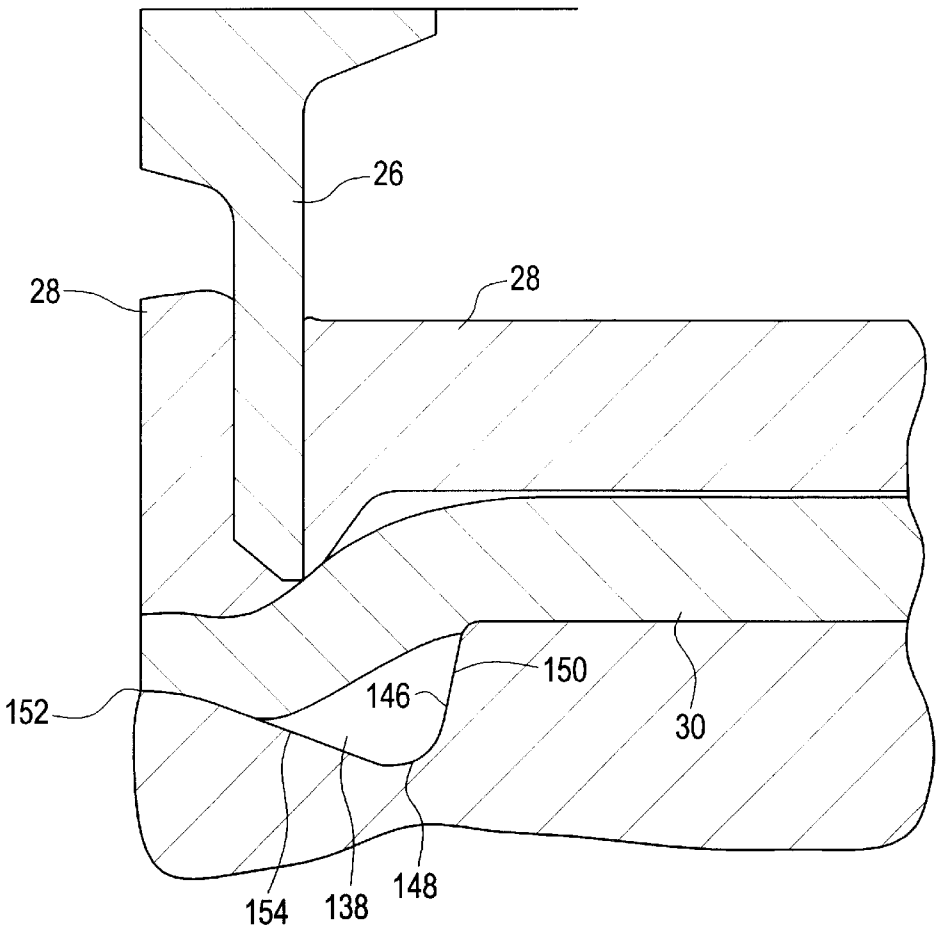
FIG. 6 PRIOR ART
Figure 7:
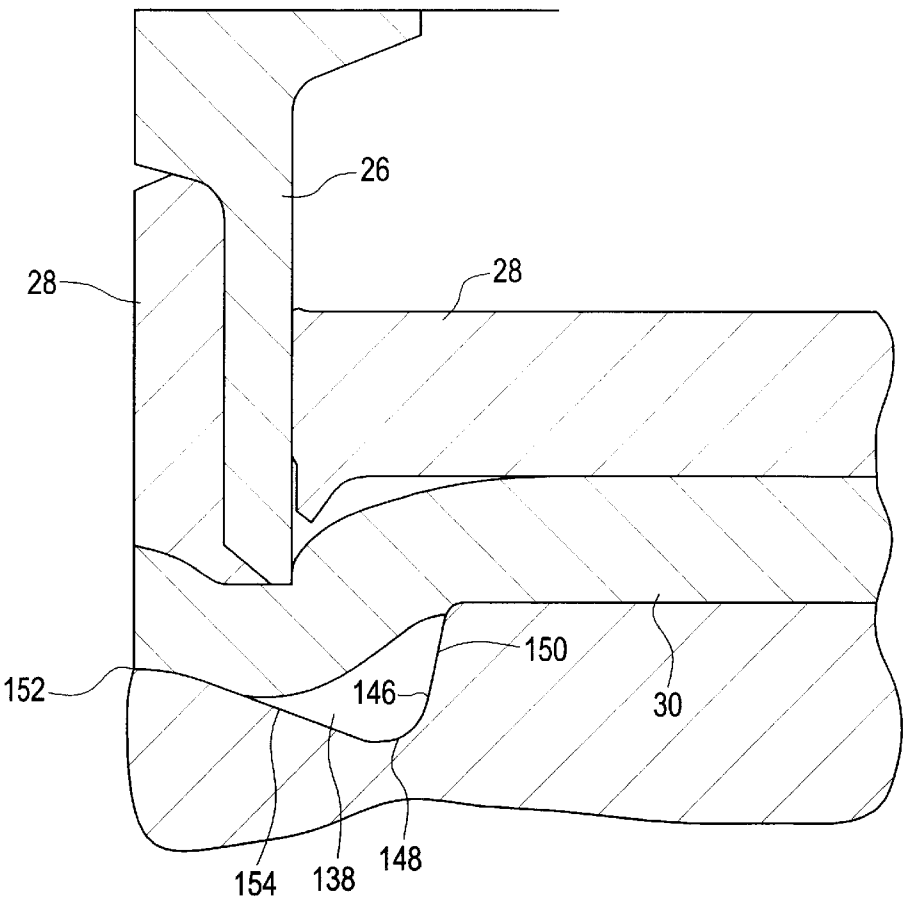
FIG. 7 PRIOR ART
Figure 8:
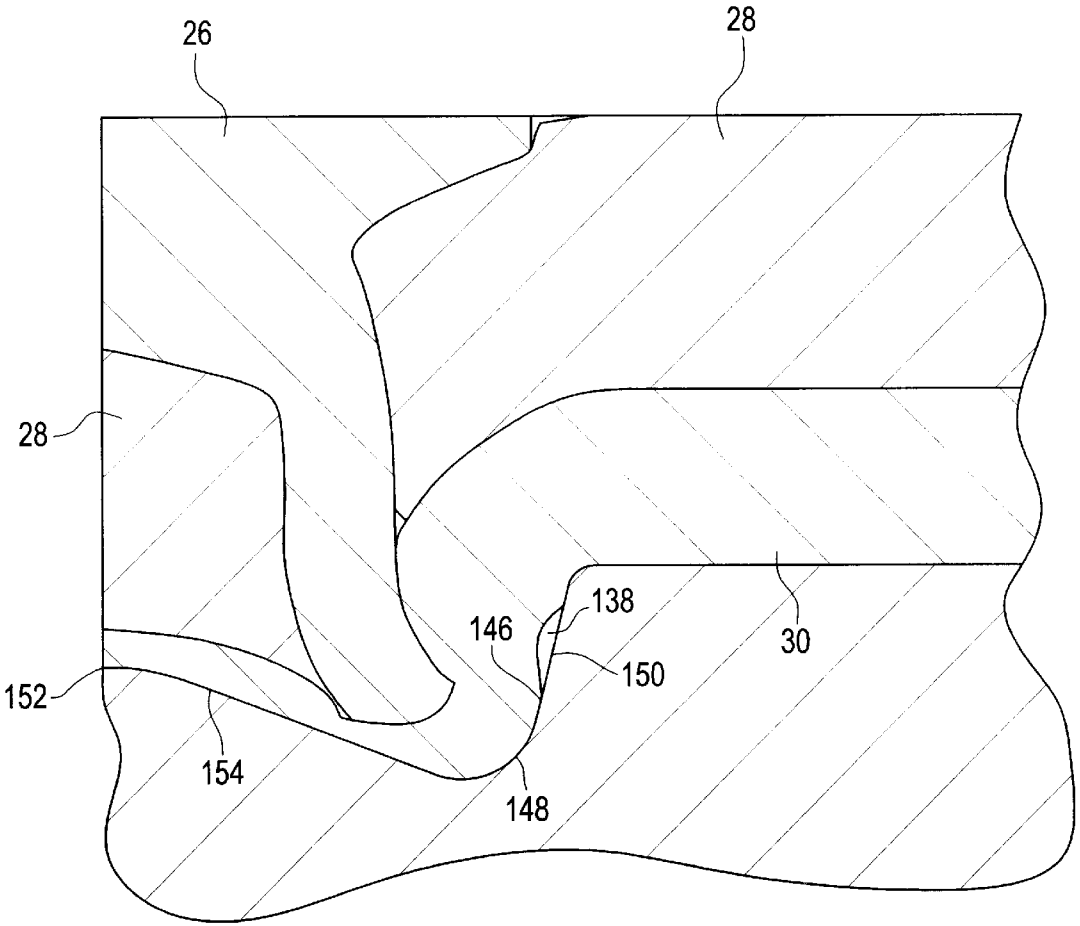
FIG. 8 PRIOR ART
Figure 9:
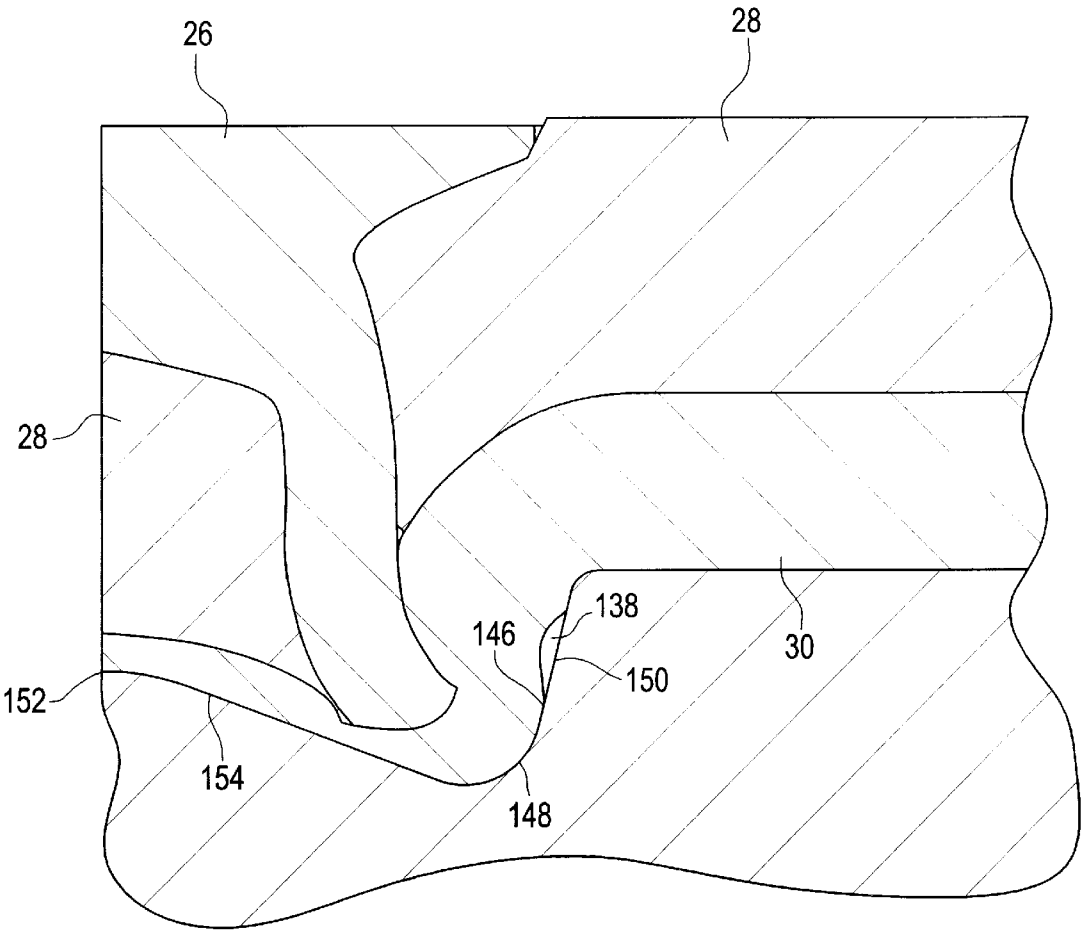
FIG. 9 PRIOR ART

Similar to the prior art anvil 136 shown in FIGS. 3 and 4, the anvil 236, shown in FIGS. 10 and 11, generally has a first portion 240 and a second portion 242. The second portion 242 is dimensioned to fit within the C-shaped frame 22 of the rivet setting machine 20 (see FIG. 1) while the first portion 240 is dimensioned to be positioned on top of the C-shaped frame 22. At an end 244 of the first portion 240, opposite where the first portion 240 and the second portion 242 of the anvil 236 are joined together, a cavity 238 is formed therein which allows for the accommodation of rivets 26 and workpieces 28, 30 during a riveting process. The end 244 of the first portion 240 also supports the workpieces 28, 30 during the riveting process. The anvil 236 can be formed of any suitable material which can handle the stress and strain of the riveting process.

At the end 244 of the first portion 240, the cavity 238 has a diameter 243 that is smaller than a diameter 243 of the first portion 240 of the anvil 236. The cavity 238 typically generally defines a relief portion 239 and a main portion 254. The main portion 254 extends from a center 252 of the first portion 240, at a position within the first portion 240 and away from the end 244 of the first portion 240, at a straight angle toward a side 255 of the anvil 236. The main portion 254 also is preferably curved proximate to the center 252, as best illustrated in FIG. 11, to assist in the accommodation of the deformation of the workpiece 30.

The relief portion 238 of the cavity 238 is defined by a side wall 246 having three separate portions. The first portion 250 of the side wall 246 is a straight angled portion which extends from the end 244 of the first portion 240 of the anvil 236 into the first portion 240 toward the second portion 242. The first portion 250 extends from the end 244 toward the second portion 242 at a straight, inward angle such that the diameter of the cavity 238 proximate to the end 244 is larger than the diameter of the cavity 238 proximate to the second portion 242. Where the first portion 250 meets the end 244 of the first portion 240, the first portion 250 can be curved, if desired, as best illustrated in FIG. 11, to assist in allowing the workpiece 30 to deform into the cavity 238.

The side wall 246 further has a second portion 248 which is generally arced. A first end of the second portion 248 extends from an end of the first portion 250 which is proximate to the second portion 242 of the anvil 236. The second end of the second portion 248 extends to an end of a third portion 251 of the side wall 246. The second, arced portion 248 is defined by a radius R1 and is generally a concave arc when viewed as in FIG. 11.

The third portion 251 of the side wall 246 is also generally arced. As previously stated, one end of the third portion 251 connects to an end of the second portion 248. The opposite end of the third portion 251 connects to an end of the main portion 254 that is distal from the center 252. The third, arced portion 251 is defined by a radius R4 and is generally a convex arc when viewed as in FIG. 11.

The first portion 250 of the side wall 246 generally extends into the first portion 240 of the anvil 236 at a distance where a line 255 tangential to a surface of the main portion 254 would extend were the main portion 254 not separated from the first portion 250 of the side wall 246 by the second and third portions 248, 251 of the side wall 246. The area 257 defined by the second portion 248, the third portion 251 and the tangential line 255 defines a relief pocket 253 in the cavity 238 of the anvil 236.

The following table denotes, with the reference characters being illustrated in FIG. 11, the dimensions of a preferred embodiment of the invention in Column 1, and an acceptable range of dimensions of the invention in Column 2.

| | Column 1 | Column 2 |
|---|---|---|
| R1 | 0.635 mm | Tangent to D1, u2, u3 |
| R2 | 0.50 mm | 0.20 mm to 0.60 mm |
| R3 | 2.60 mm | 0.20 mm to 3.0 mm |
| R4 | 0.60 mm | 0.30 mm to R1 |
| u1 | 140° | 100° to 140° |
| u2 | 14° | 12° to 15° |
| u3 | 14° | 12° to 15° |
| A | 9.85 mm | Variable dependent upon size of rivet |
| C | 7.98 mm | 0.8 × Z to 0.9 × Z |
| D1 | 3.00 mm | Variable dependent upon size of rivet |
| D2 | 2.10 mm | Variable dependent upon size of rivet |
| Z | 9.11 mm | A-2 × D1 × tan(u2/2) |

The acceptable range of dimensions for A, D1 and D2 are all determined based on the size of rivet 26 that is used in the riveting process, as the larger the rivet 26 is, the larger the dimension A, D1 and D2 will have to be.

Figure 12:
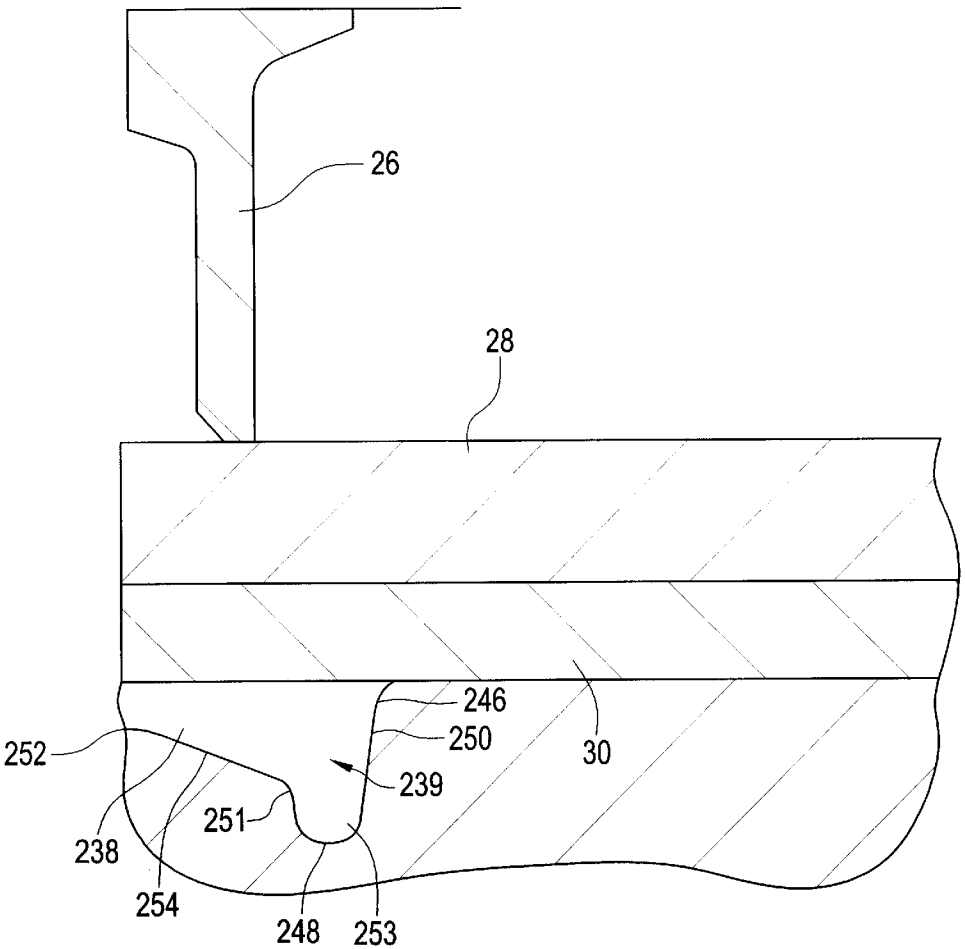
FIGS. 12–16 are cross-sectional views illustrating the installation of a rivet using the anvil shown in FIGS. 10 and 11.
Figure 13:
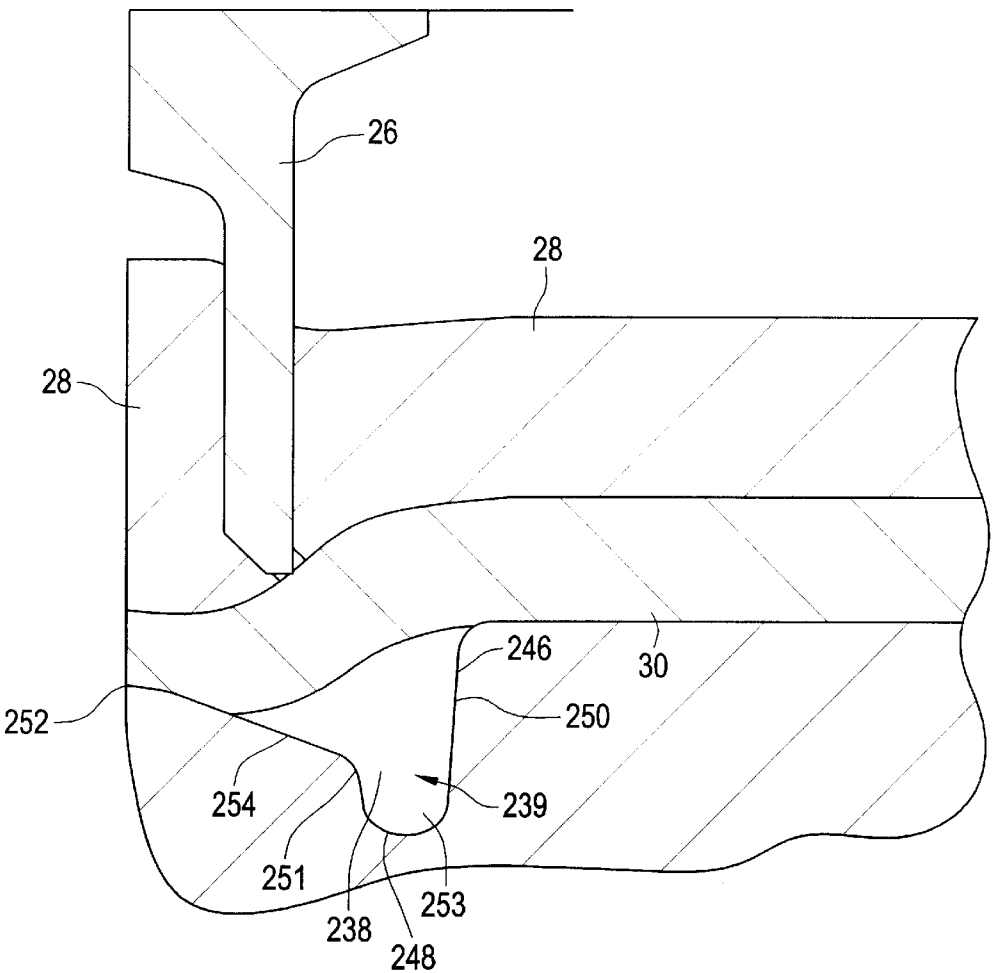
Figure 14:
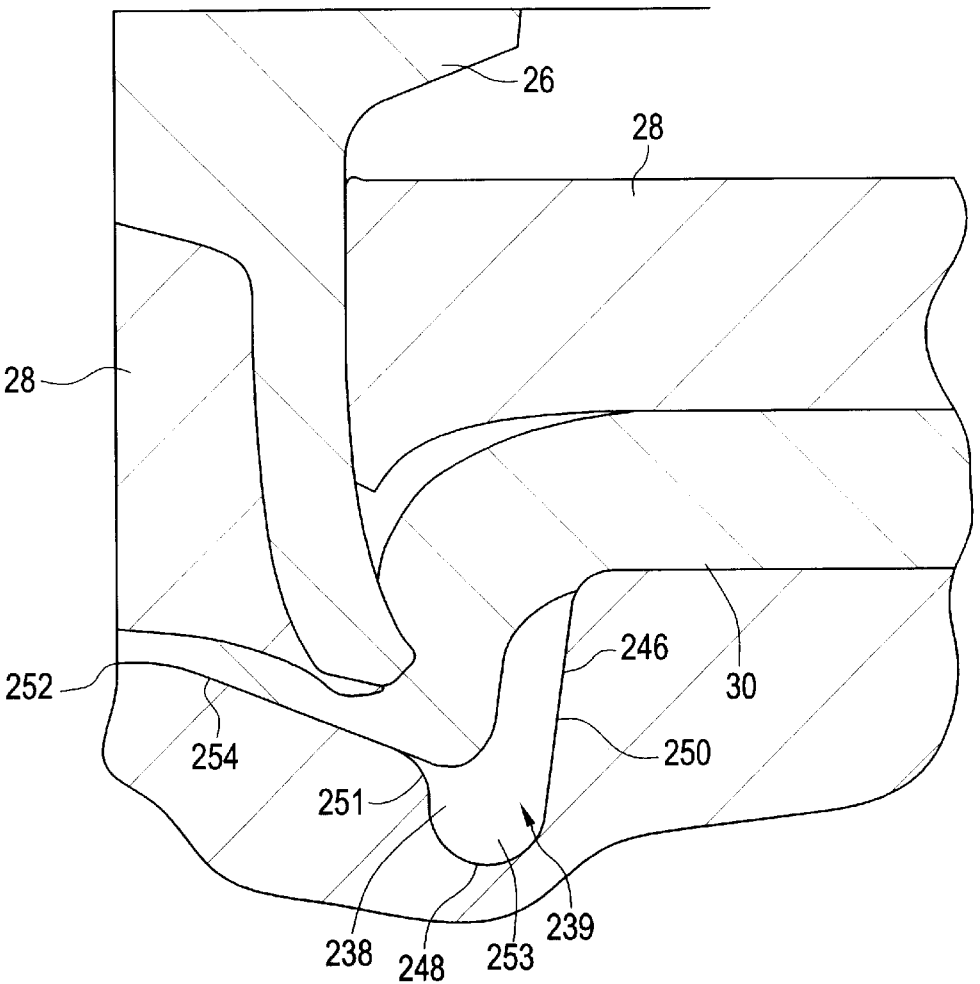

A riveting process utilizing the anvil 236, shown in FIGS. 10 and 11, will now be discussed with relation to FIGS. 12–16. As illustrated in FIG. 12, initially the end 244 of the anvil 236 supports the workpieces 28, 30 and the rivet 26 is forced into contact with the workpiece 28 by the rivet setting machine 20, such that it begins to pierce through the workpiece 28. As the rivet 26 continues to pierce through the workpiece 28 as illustrated in FIGS. 13 and 14, the workpiece 30 deforms into the cavity 238 of the anvil 236 such that the main portion 254 of the cavity 238 supports the workpiece 30.

Figure 15:
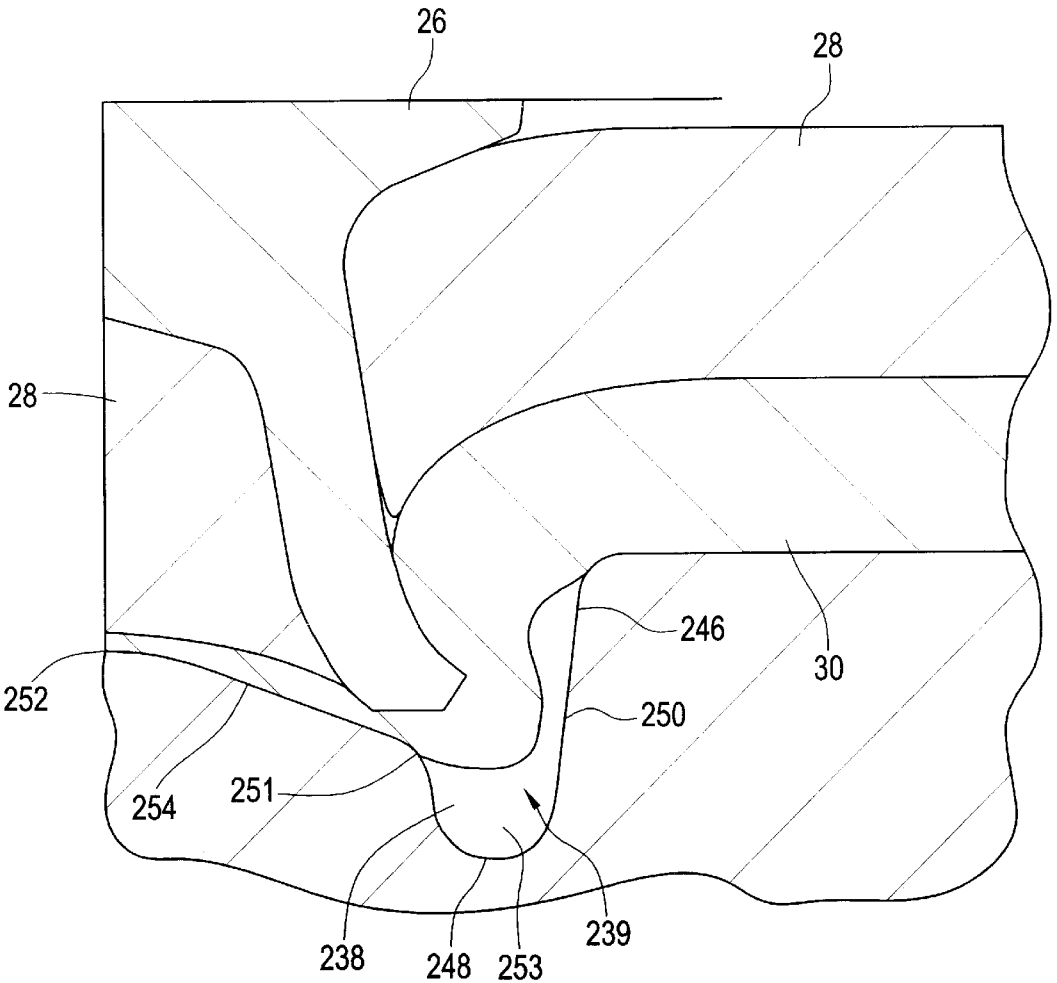
Figure 16:
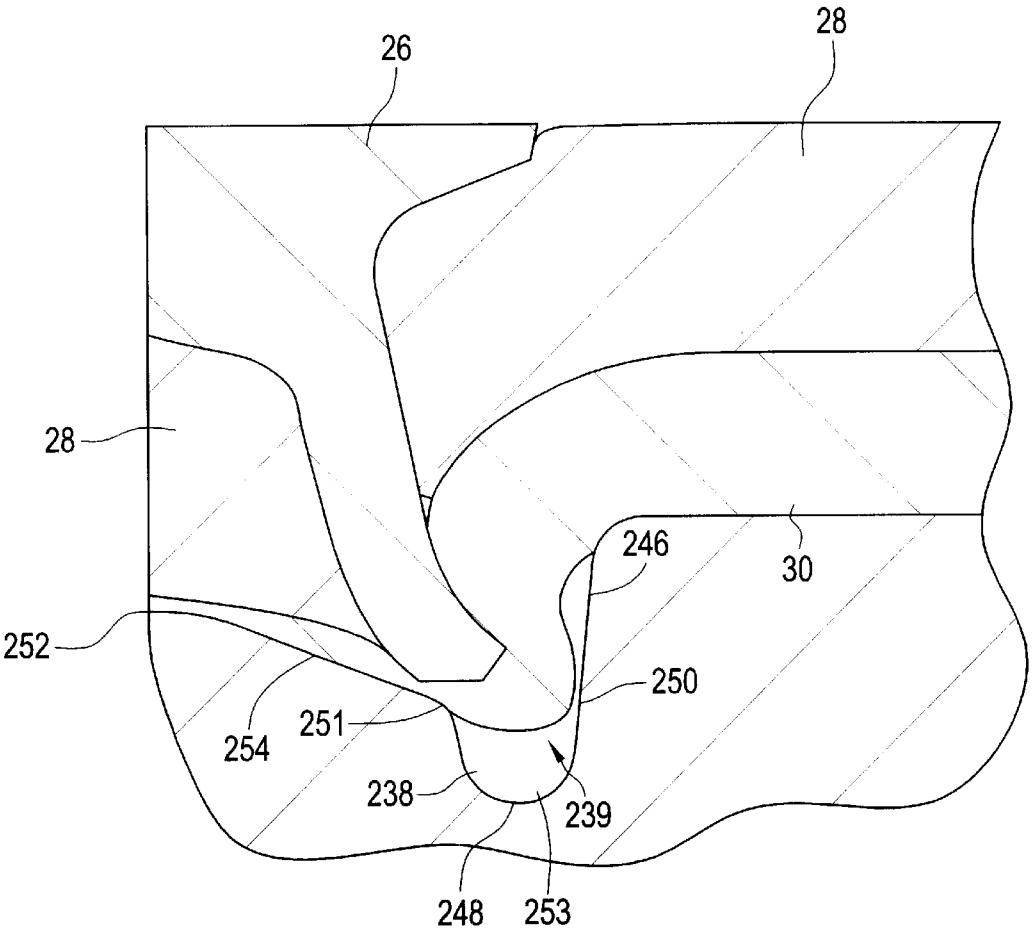

As illustrated in FIGS. 15 and 16, the continued forcing of the rivet 26 into the workpieces 28, 30, which is necessary for the attachment of the rivet 26 to the workpieces 28, 30, causes the workpiece 30 and the rivet 26 to deform in accordance with the configuration of the cavity 238 such that the rivet 26 is forced toward the second portion 248 of the side wall 246 of the cavity 238.

In stark contrast to the riveting process utilized with the cavity 138 of the prior art anvil 136, the riveting process utilized with the cavity 238 of the anvil 236 allows for the workpiece 30 and the rivet 26 to freely deform within the relief portion 239 of the cavity 238 as the workpiece 30 only abuts against the main portion 254 of the cavity 238. The deforming workpiece 30 does not substantially, if at all, abut against any portion of the side wall 246 of the cavity 238. Thus, the side wall 246 does not hinder, in any way, the deformation of the workpiece 30 as the relief pocket 253 within the cavity 238 provides for an extra area for the material of the workpiece 30 to flow to during the deformation thereof.

As the workpiece 30 is free to deform due to the extra space provided by the relief pocket 253, the stress placed on the anvil 236 and on the rivet setting machine 20 is not heightened as is the stress placed on the anvil 136 and the rivet setting machine 20 once the workpiece 30 begins to abut against the arced portion 148 and the straight portion 150 of the side wall 146. The sharper angle of the first portion 250 of the side wall 246 also substantially aids in preventing the workpiece 30 from deforming into, and abutting, the first portion 250 of the side wall 246, unlike the side wall 146 provided for in the prior art anvil design. As the stress is reduced, the amount of power or load required to perform the riveting process is reduced, thus allowing for the downsizing of the C-frame 22, an advantage in cost savings. Reducing the power or load required, also allows for the rivet setting machine 20 to be powered pneumatically as opposed to hydraulically, thus providing an advantage that the rivet setting machine 20 is substantially lighter and cheaper to make.

The anvil 236 also experiences less wear and tear during the riveting process than does the prior art anvil 136 shown in FIGS. 3 and 4, thus allowing for savings due to the need to replace the anvil less frequently. Also, as the anvil 236 has the relief pocket 253 provided therein, the rivet setting machine 20 (see FIG. 1). utilizing the anvil 236 is capable of handling a wider variance in the range of the workpiece 28, 30 thickness, as the relief pocket 253 is able to accommodate a larger variance of thickness of workpieces due to the extra area provided therein for allowing the workpieces to deform therein.

Thus, the anvil design shown in FIGS. 10 and 11 provides that a relief pocket 253 is provided in the cavity 238 into which the workpiece 30 deforms while a rivet 26 is being installed during a riveting process. The presence of the relief pocket 253 in the cavity 238 reduces the amount of stress acting on the anvil 236 and the rivet setting machine 20, which in turn, provides a number of advantages as discussed hereinabove.

While a preferred embodiment of the present invention is shown and described, it is envisioned that those skilled in the art may devise various modifications without departing from the spirit and scope of the following claims.

The invention is claimed as follows:

1. An anvil for a rivet setting machine configured to drive a rivet into a workpiece within a riveting process, said anvil comprising: a member having a cavity therein configured to accommodate a deformation of the rivet and workpiece during the riveting process, said cavity defined by a main portion configured to support the workpiece during the riveting process and a relief portion proximate said main portion, said relief portion configured to provide an area into which the workpiece and rivet deform during the riveting process, said relief portion having a depth sufficient to provide at least one relief pocket configured to maintain an area which remains substantially unoccupied by the workpiece and rivet throughout the entire riveting process, wherein said relief portion does not substantially hinder the workpiece and rivet during the riveting process, and wherein said relief portion allows the workpiece and rivet to freely deform during the riveting process.

2. An anvil as defined in claim 1, wherein said relief portion defines at least one side wall, said at least one side wall extending angularly inwardly toward said main portion.

3. An anvil as defined in claim 2, wherein said main portion extends angularly downwardly from a center of said cavity toward said at least one side wall.

4. An anvil as defined in claim 3, wherein said relief pocket is situated at a position below a line tangential to a surface of said main portion.

5. An anvil as defined in claim 1, wherein said member has opposite first and second portions, said first portion of said member configured to abut and support the workpiece during the riveting process, said second portion of said member configured such that said member is affixable to the rivet setting machine, said first portion of said member having said cavity therein.

6. An anvil for a rivet setting machine configured to drive a rivet into a workpiece within a riveting process, said anvil having a surface and a cavity defined in said surface, said cavity including a relief pocket which has a depth sufficient to provide that said relief pocket does not become substantially filled with the workpiece and the rivet as the workpiece and the rivet deform during the riveting process, wherein said relief pocket allows the workpiece and rivet to freely deform during the riveting process.

7. An anvil as defined in claim 6, wherein said cavity defines a relief portion and a main portion, said main portion configured to support the workpiece during the riveting process and said relief portion being proximate to said main portion, said relief pocket being a part of said relief portion.

8. An anvil as defined in claim 7, wherein said relief portion defines at least one side wall, said at least one side wall extending angularly inwardly toward said main portion.

9. An anvil as defined in claim 8, wherein said main portion extends angularly downwardly from a center of said cavity toward said at least one side wall.

10. An anvil as defined in claim 9, wherein said relief pocket is situated at a position below a line tangential to a surface of said main portion.

11. An anvil as defined in claim 6, wherein said anvil has opposite first and second portions, said surface of said anvil being at a first end of said first portion of said anvil, said first portion of said anvil configured to abut and support the workpiece during the riveting process, said second portion of said member configured such that said anvil is affixable to the rivet setting machine.

12. An anvil for a rivet setting machine comprising a member having a cavity therein for accommodating a deformation of a workpiece during a riveting process, said cavity defining at least one side wall and a main portion with an end of said at least one side wall being connected to an end of said main portion, said at least one side wall extending angularly inwardly toward said main portion, said main portion generally extending angularly downwardly from, a center of said cavity toward said at least one side wall, said at least one side wall and said main portion being connected by an arced portion, said arced portion forming a relief pocket within said cavity, said relief pocket being situated at a position below a line tangential to a surface of said main portion, said relief pocket having a depth sufficient to provide an area which remains substantially unoccupied by the workpiece and rivet throughout the entire riveting process.

13. An anvil as defined in claim 12, wherein said member has opposite first and second portions, said first portion of said member configured to abut and support the workpiece during said riveting process, said second portion of said member configured such that said member is affixable to the rivet setting machine, said first portion of said member having said cavity therein.

14. An anvil as defined in claim 13, wherein said at least one side wall has a first end and a second end, said first end of said at least one side wall being connected to an end of said member, said second end of said at least one side wall being connected to an end of said arced portion, said at least one side wall extending angularly inwardly from said end of said member to an end of said arced portion such that said cavity has a width proximate to said end of said member that is larger than a width of said cavity proximate to said arced portion of said cavity, said at least one side wall allowing for deformation of the workpiece during the riveting process wherein the workpiece does not encounter resistance from said at least one side wall during said deformation.

15. An anvil as defined in claim 13, wherein said main portion generally extends angularly downwardly from a center of said cavity away from said end of said member and toward said at least one side wall.

16. An anvil for a rivet setting machine, said anvil comprising:

a member having opposite first and second portions, said first portion configured to abut and support a workpiece during a riveting process, said second potion configured such that said member is affixable to the rivet setting machine, said first portion having a cavity therein for accommodating a deformation of the workpiece during the riveting process;

said cavity defining at least one side wall and a main portion, said at least one side wall having a straight portion and an arced portion, said straight portion having a first end and a second end, said first end of said straight portion being connected to an end of said member, said second end of said straight portion being connected to said arced portion, said straight portion extending angularly inwardly from said end of said member to said arced portion such that said cavity has a width proximate to said end of said member that is larger than a width of said cavity proximate to said arced portion of said cavity, said straight portion allowing for deformation of said workpiece during the riveting process, wherein said workpiece does not encounter resistance from said straight portion during said deformation;

said arced portion having first and second ends, said first end of said arced portion being connected to said second end of said straight portion and said second end of said arced portion being connected to said main portion;

said main portion generally having a first end and a second end, said first end of said main portion being connected to said second end of said arced portion such that said arced portion is positioned generally between said straight portion and said main portion;

said second end of said main portion generally extending to a center of said cavity, said main portion extending from said center of said cavity at an angle away from said end of said member and toward said straight portion;

said arced portion forming a relief pocket within said cavity, said relief pocket being situated at a position below a line tangential to a surface of said main portion, said relief pocket having a depth sufficient to provide an area which remains substantially unoccupied by the workpiece and rivet throughout the entire riveting process.

17. A method of attaching a rivet to a workpiece with a rivet setting machine, said method comprising the steps of:

a) providing the rivet setting machine with an anvil having a cavity therein, said cavity being defined by a main portion and a relief portion proximate to said main portion, said relief portion further including a relief pocket, said relief pocket having a depth sufficient to provide an area which remains substantially unoccupied by the workpiece and rivet throughout the entire riveting process;

b) driving the rivet into the workpiece;

c) Supporting the workpiece on said main portion;

d) deforming the workpiece and the rivet into said relief portion;

e) accommodating the deformation of the workpiece and the rivet in said relief portion without the workpiece substantially deforming into the relief pocket, such that the workpiece and rivet can freely deform without hindrance.

18. A method as defined in claim 17, wherein said relief portion defines at least one side wall, said at least one side wall extending angularly inwardly toward said main portion.

19. A method as defined in claim 18, wherein said main portion extends angularly downwardly from a center of said cavity toward said at least one side wall.

20. A method as defined in claim 19, wherein said relief pocket is situated at a position below a line tangential to a surface of said main portion.

21. A method as defined in claim 19, wherein said anvil has opposite first and second portions, said first portion of said anvil configured to abut and support said workpiece, said second portion of said anvil configured such that said anvil is affixable to the rivet setting machine, said first portion of said anvil having said cavity therein.

22. A method of attaching a rivet to a workpiece with a rivet setting machine, said method comprising the steps of:

a) providing the rivet setting machine with an anvil having a cavity therein, said cavity being defined by a main portion and a relief portion proximate to said main portion, said relief portion further including a relief pocket;

b) driving the rivet into the workpiece;

c) supporting the workpiece on said main portion;

d) deforming the workpiece and the rivet into said relief portion;

e) accommodating the deformation of the workpiece and the rivet in said relief portion without the workpiece substantially deforming into the relief pocket, such that the workpiece and rivet can freely deform without hindrance, wherein said relief portion defines at least one side wall, said at least one side wall extending angularly inwardly toward said main portion, wherein said main portion extends angularly downwardly from a center of said cavity toward said at least one side wall.

23. A method as defined in claim 22, wherein said relief pocket is situated at a position below a line tangential to a surface of said main portion.

24. A method as defined in claim 22, wherein said anvil has opposite first and second portions, said first portion of said anvil configured to abut and support said workpiece, said second portion of said anvil configured such that said anvil is affixable to the rivet setting machine, said first portion of said anvil having said cavity therein.

* * * * *